US005659336A

United States Patent [19]

Patrick et al.

[11] Patent Number: 5,659,336

[45] Date of Patent: Aug. 19, 1997

[54] METHOD AND APPARATUS FOR CREATING AND TRANSFERRING A BITMAP

[75] Inventors: Stuart Raymond Patrick, Issaquah; Amit Chatterjee, Redmond, both of Wash.

[73] Assignee: Microsoft Corporation, Redmond, Wash.

[21] Appl. No.: 328,715

[22] Filed: Oct. 24, 1994

[51] Int. Cl.[6] ..... G09G 5/00

[52] U.S. Cl. ..... 345/185; 345/189

[58] Field of Search ..... 345/185, 189, 345/186, 112, 132, 133, 141, 192; 395/164, 162, 163

[56] References Cited

U.S. PATENT DOCUMENTS 5,224,210 6/1993 Pinedo et al. ..... 395/164
5,381,347 1/1995 Gery ..... 395/163

OTHER PUBLICATIONS

"Device Driver Adaption Guide" Microsoft Corporation, 1992; Chapter 1, 2 & 10.

*Primary Examiner*—Regina D. Liang
*Attorney, Agent, or Firm*—Klarquist Sparkman Campbell Leigh & Whinston, LLP

[57] ABSTRACT

In response to a command to draw text on a screen, a computer's operating system creates a superglyph bitmap that combines text and a background color into a single bitmap. The bitmap is then transferred to screen memory by either a graphics driver or the operating system itself, depending upon whether the graphics driver has special characteristics for displaying the bitmap such as monochrome-to-color conversion. With this division of tasks, graphics drivers may be simplified to handle tasks for which they are uniquely qualified and the operating system handles more general tasks such a creating the bitmap. The concept may also be applied to other types of bitmaps, wherever it is advantageous to create bitmaps with the operating system and transfer bitmaps with either a graphics driver or the operating system.

20 Claims, 14 Drawing Sheets

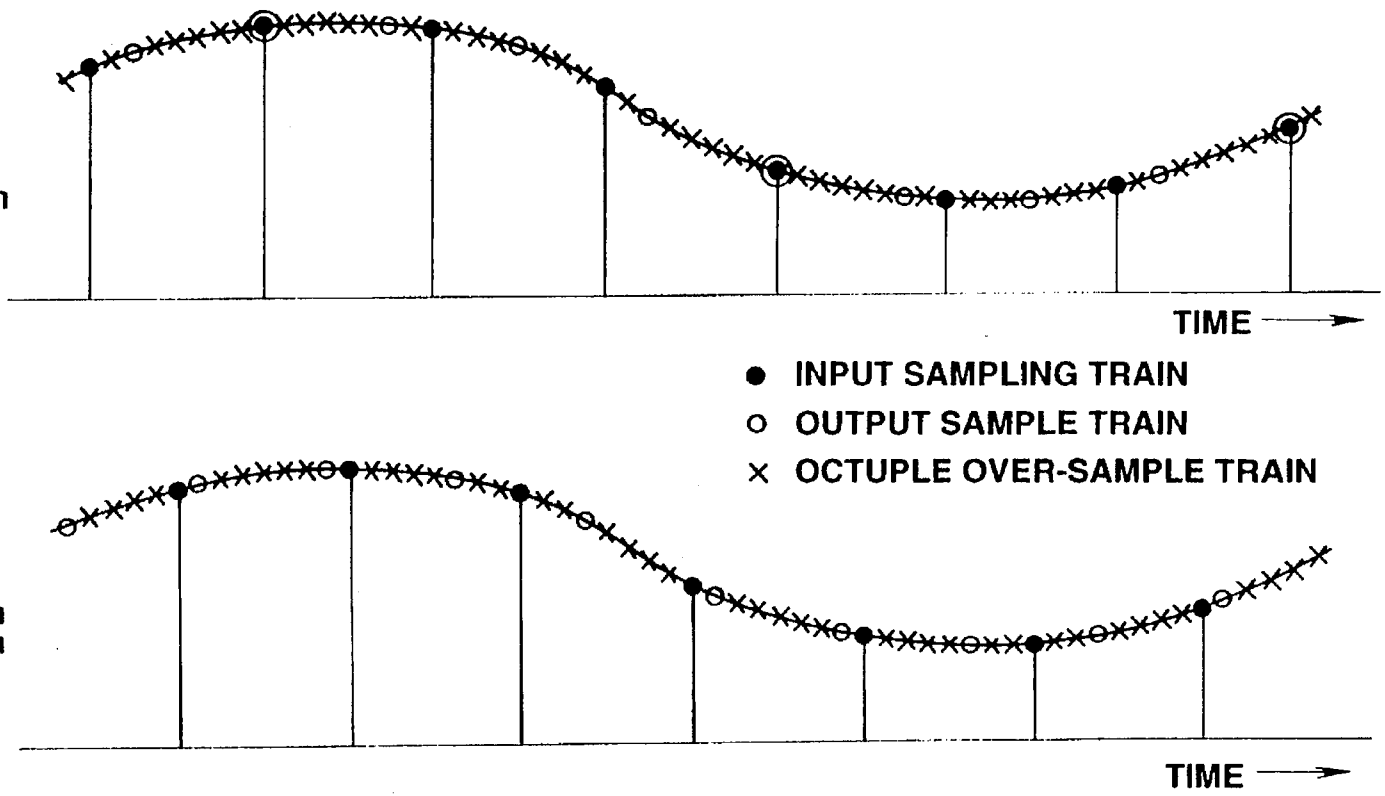
FIG.3(A) G-ch
FIG.3(B) R-ch B-ch

| TIME | INPUT | OUTPUT | | | |
|---|---|---|---|---|---|
| | | REGISTER 21 | REGISTER 22 | REGISTER 23 | REGISTER 24 |
| t0 | D | C | B | B | A |
| t1 | E | D | C | B | B |
| t2 | E | E | D | C | B |
| t3 | F | E | E | D | C |
| t4 | G | F | E | E | D |

FIG.9

STOP OF CLOCK

| TIME | INPUT | OUTPUT | | | |
|---|---|---|---|---|---|
| | | REGISTER 21 | REGISTER 22 | REGISTER 23 | REGISTER 24 |
| t0 | E | D | C | B | A |
| t1 | F | E | D | C | B |
| t2 | F | E | D | C | B |
| t3 | G | F | E | D | C |
| t4 | H | G | F | E | D |

FIG.13

| COE 1 | COE 2 | COE 3 | COE 4 |
|---|---|---|---|
| -1 | 8 | 60 | -3 |
| -3 | 26 | 46 | -5 |
| -5 | 46 | 26 | -3 |
| -3 | 60 | 8 | -1 |

FIG.14

| COE 1 | COE 2 | COE 3 | COE 4 |
|---|---|---|---|
| -2 | 16 | 55 | -5 |
| -5 | 37 | 37 | -5 |
| -5 | 55 | 16 | -2 |
| 1 | 62 | 1 | 0 |

FIG.15

METHOD AND APPARATUS FOR CREATING AND TRANSFERRING A BITMAP

FIELD OF THE INVENTION

This invention relates generally to computer graphics. More particularly, this invention relates to a method and apparatus for simplifying the drawing of text on a display or other graphics device of a computer system.

BACKGROUND OF THE INVENTION

Computer operating systems now commonly provide for displaying text (data that consists of characters representing the words and symbols of human speech) as a series of graphical objects. Each text character has an associated bitmap and is drawn much like any other graphical object is drawn. By using graphical objects for displaying text, the text characters may appear in a variety of fonts and sizes.

The process for drawing text on a graphics device such as a printer or display employs the computer's operating system and a graphics driver. Typically, an application program such as a word processor calls a "textout" function or equivalent subroutine in the computer's operating system and provides the function with a string of characters for display. The operating system, in turn, calls a function in a graphics driver for the particular graphics device and passes the graphics driver the character string and other relevant parameters such as size, font, drawing location, etc. The graphics driver, which is a specialized program for operating a particular graphics device, then performs the actual drawing of the text. For example, if the graphics device is a display, then a display driver draws the text on screen memory one character at a time, from where it is read and physically displayed to a user.

For proportionally-spaced fonts in which adjacent characters may overlap, the process of drawing characters can produce noticeable flickering on a display screen. An example of such a font is Times Roman. Typically with proportionally-spaced fonts, the process of drawing characters is a two-step operation. First, an opaque rectangle is drawn to cover the screen area in which the characters will be appear. This effectively erases what appeared in the area before. Second, each of the characters is drawn on top of the opaque rectangle where they may overlap. For example, displaying the letters "tex" using this technique requires first drawing an opaque rectangle of sufficient area to enclosed the letters. Then each of the individual letters are drawn and spaced appropriately within the rectangle. This process repeats each time an additional letter is added. For example, if a "t" is added to "tex" to form the word "text," then a new opaque rectangle is first drawn sufficient to enclose the four letters. Then the four letters are drawn within the rectangle. Thus the time consumed in drawing an additional character increases each time a character is added to the text. Eventually the delay between the disappearance of the previous text and the appearance of the newly drawn text becomes visually perceptible.

One approach to reduce flickering is to employ font caching in the graphics driver. With this technique, a graphics driver caches copies of displayed characters in a portion of screen memory that is not visible on the display. For example, if the word "hello" were drawn, copies of the characters "h," "e," "l" and "o" are cached as they are drawn. They may then be quickly copied to visible screen memory if they again appear in the text. While caching eliminates the need to copy characters from main memory each time they are to be drawn, they must still be copied to and positioned in the visible screen memory. Flickering still occurs.

Another approach in the prior art to solving the problem of flickering is to include in the graphics driver a means for creating a single bitmap that combines the opaque rectangle and the overlaid characters. The graphics drivers may then copy the single bitmap to the screen in one step. Each time a new character is added to a line of text, a new single bitmap is created and copied to the screen memory in one step. No time gap develops between the drawing of the opaque background and the characters because both are drawn simultaneously, and no flickering occurs.

While this approach may solve the flickering problem, it has several significant drawbacks. First, the code required for creating a single bitmap that includes an opaque rectangle and array of appropriately spaced characters is complex. Although the providers of graphics drivers may recognize this approach as a possible solution, they are still left with the difficult task of integrating the appropriate code with the specialized code of their graphics drivers. Too often the result is a poorly working graphics driver; consequently, to date few graphics driver providers have pursued this solution. Secondly, this solution significantly increases demands on the main memory of a computer system. Typically a computer has several graphics drivers active in its main memory at one time, each consuming precious memory resources. If each of these graphics drivers includes the code for creating a single text bitmap, then a significant amount of the computer's main memory is occupied by redundant code.

An object of the invention, therefore, is to simplify the way in which text is drawn in a computer system. Another object of the invention is to reduce the complexity of graphics drivers while still providing them with the capability for flicker-free display of text. Yet another object of the invention is to centralize the code for drawing text to minimize errors in the code's operation. Still another object of the invention is to eliminate redundant code common to graphics drivers to reduce demands on the main memory of a computer system.

To aid in understanding the invention, the following glossary is provided:

A "font" is a set of descriptions for drawing each member of a character set, with each character composed to share distinctive stylistic similarities with other characters in the font. Fonts are often defined and stored either as raster fonts, which are defined for each available font size by a set of prescaled bitmaps, or as more flexibly scalable outline fonts, which are defined by a mathematical description of the curves and lines which make up each character.

A "glyph" is the distinct visual representation of a character in a form displayable by a graphics display device. Typically, a glyph bitmap is a rectangular grid of pixels, composed of the bit pattern for a particular character, embedded within a frame of oppositely polarized bits representing a background area.

"Graphics display hardware" and "graphics device" refer to the specialized hardware, such as a video display plug-in card, that is designed to provide graphics output to a display, printer or similar output device. These terms include the graphics controllers and screen, or video, memory associated with the graphics device.

A "graphics driver" is a computer program designed to control a particular graphics hardware device such as a display, printer or plotter. Drivers are not part of a computer's operating system, but are modules that communicate with the operating system through functions calls. Graphics drivers for specialized devices such as video accelerators are normally provided by the vendor of the hardware device. Typical functions performed by a graphics driver operating the graphics hardware include fast monochrome-to-color conversion of bitmaps, drawing of repetitive patterns in screen memory and the moving of an image from one portion of screen memory to another. The operating system cannot perform these functions as quickly because unlike the graphics drivers, the operating system is not adapted to take advantage of the graphics hardware's unique capability.

SUMMARY OF THE INVENTION

In accordance with the invention, a method and apparatus for creating a bitmap such as a text bitmap in memory and transferring the bitmap to a graphics device is disclosed. As part of the method and apparatus, an operating system is provided in memory for creating a bitmap and transferring the bitmap to a graphics device. Also provided in memory is a graphics driver for transferring a bitmap to a graphics device. In response to a request to the graphics driver to transfer a bitmap to a graphics device, the operating system is notified to create the bitmap. The operating system is further notified whether it or the graphics driver is to transfer the bitmap to the graphics device. The operating system then creates the bitmap.

If the operating system has been notified to transfer the bitmap to the graphics device, it proceeds to do so. However, if the operating system has been notified that the graphics driver is to transfer the bitmap to the graphics device, the operating system notifies the graphics driver of the location of the bitmap. The graphics driver then proceeds to transfer the bitmap from the location to the graphics device.

Notifications may be provided by function calls between the operating system and graphics driver. The graphics driver notifies the operating system by providing a parameter value in a function call which indicates whether the graphics driver or operating system is to transfer the bitmap to the graphics device. If the graphics driver is to handle the transfer, the operating system responds by a function call that contains the location of the bitmap for the graphics driver to access.

Whether the graphics driver or operating system is to transfer the bitmap to the graphics device is determined by the nature of the requested transfer. Graphics drivers are better suited for certain types of bitmap transfers such as monochrome-to-color conversions, pattern copying and the rapid moving of an image from one part of screen memory to another. The operating system may handle simpler bitmap transfers. Graphics drivers may then be written to focus on their specialized tasks rather than trying to accomplish all types of transfers.

As importantly, the process of creating a bitmap is centralized in the operating system and not performed by the numerous graphics drivers that may be resident in memory. This centralization improves the reliability of the code for creating the bitmap and eliminates redundant code otherwise contained in all of the graphics drivers.

The foregoing and other objects, features, and advantages of the invention will become more apparent from the following detailed description of a preferred embodiment which proceeds with reference to the accompanying drawings.

DETAILED DESCRIPTION OF A PREFERRED EMBODIMENT

Figure 1:
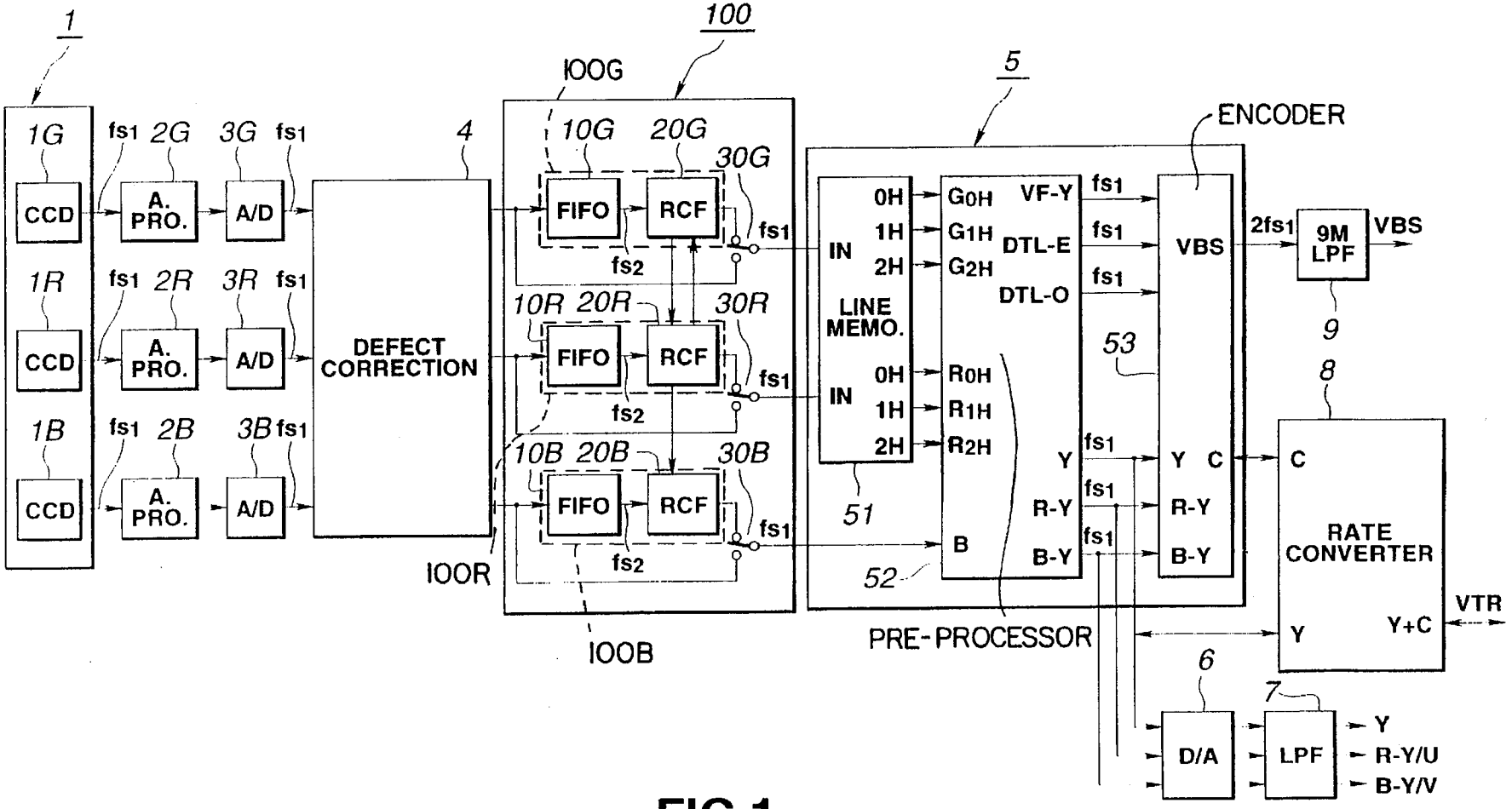
FIG. 1 is a block diagram of a computer system that may be used to implement a method and apparatus embodying the invention.
Figures 2A, 2B, 2C, 2D, 2E, 2F, 2G, 2H, 2I:
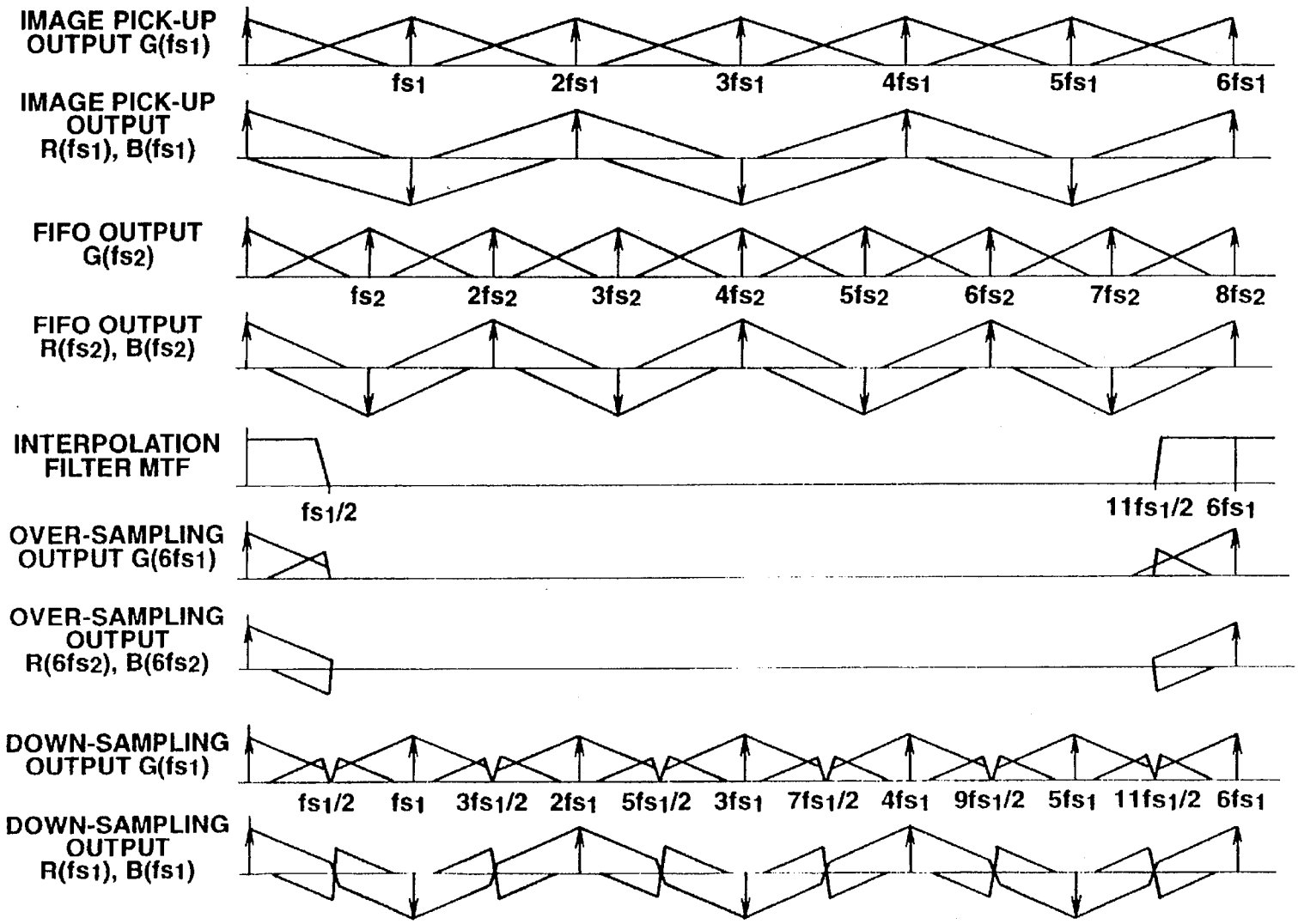
FIG. 2 is a block diagram of an application program, operating system, graphics drivers and graphics device within a computer system such as shown in FIG. 1.

FIG. 1 is a block diagram of a computer system 20 which is used to implement a method and apparatus embodying the invention. Computer system 20 includes as its basic elements a computer 22, input device 24 and output device 26.

Computer 22 generally includes a central processing unit (CPU) 28 and a memory system 30 that communicate through a bus structure 32. CPU 28 includes an arithmetic logic unit (ALU) 33 for performing computations, registers 34 for temporary storage of data and instructions and a control unit 36 for controlling the operation of computer system 20 in response to instructions from a computer program such as an application or an operating system.

Memory system 30 generally includes high-speed main memory 38 in the form of a medium such as random access memory (RAM) and read only memory (ROM) semiconductor devices and secondary storage 40 in the form of a medium such as floppy disks, hard disks, tape, CD-ROM, etc. and other devices that use optical or magnetic recording material. Main memory 38 stores programs such as a computer's operating system and currently running application programs. Main memory 38 also includes video display memory for displaying images through a display device.

Input device 24 and output device 26 are typically peripheral devices connected by bus structure 32 to computer 22. Input device 24 may be a keyboard, modem, pointing device, pen, or other device for providing input data to the computer. Output device 26 may be a display device, printer, sound device or other device for providing output data from the computer.

It should be understood that FIG. 1 is a block diagram illustrating the basic elements of a computer system; the figure is not intended to illustrate a specific architecture for a computer system 20. For example, no particular bus structure is shown because various bus structures known in the field of computer design may be used to interconnect the elements of the computer system in a number of ways, as desired. CPU 28 may be comprised of a discrete ALU 33, registers 34 and control unit 36 or may be a single device in which these parts of the CPU are integrated together, such as in a microprocessor. Moreover, the number and arrangement of the elements of the computer system may be varied from what is shown and described in ways known in the art (i.e., multiple CPUs, client-server systems, computer networking, etc.).

Figure 2:
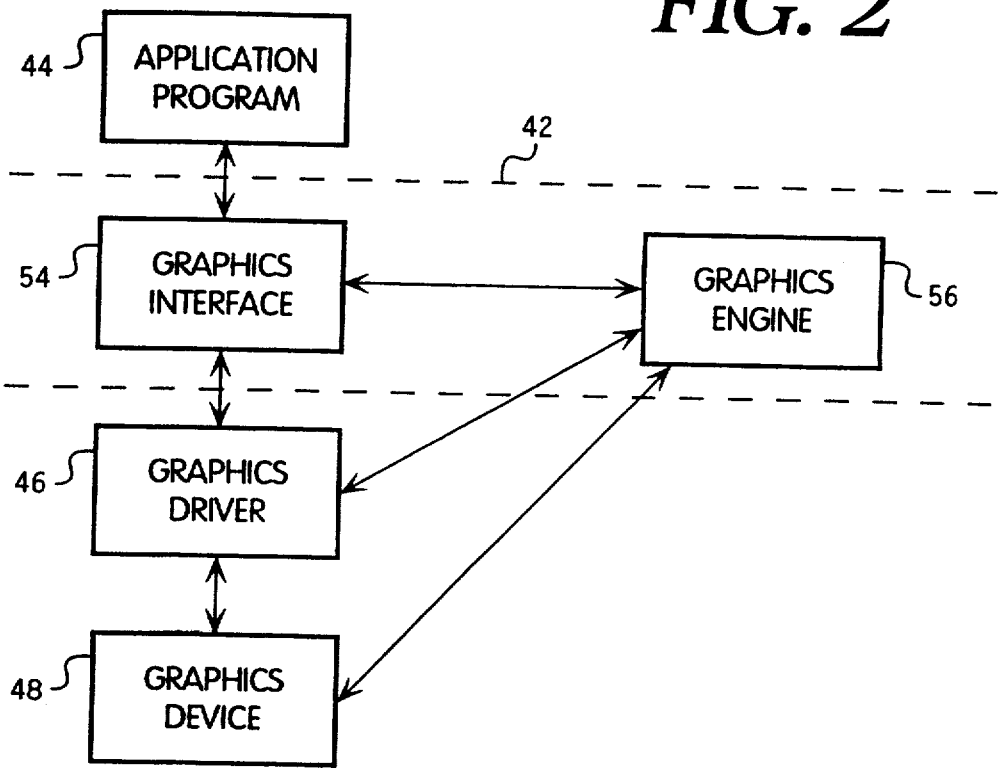

FIG. 2 is a block diagram of a portion of an operating system 42 in communication with an application program 44 and a graphics driver 46. These elements are preferably resident in main memory 38, but they may also reside in secondary storage 40 and be swapped in and out of the main memory as needed. Operating system 42 further communicates with a graphics device 48 such as a graphics adapter that includes video (screen) memory or a printer that includes a memory buffer. Within the illustrated portion of operating system 42 are a graphics interface 54 and a graphics engine 56. Each of the blocks in FIG. 2 except for graphics device 48 is typically implemented as a module of code containing a set of related functions.

In the process of drawing text on a graphics device, application program 44 calls a text drawing function in graphics interface 54, passing the necessary text information as parameters to the function. Graphics interface 54, in turn, calls an appropriate text drawing function in a graphics driver 46 and passes it the necessary parameters. The graphics driver, upon recognizing the request for drawing text, notifies a graphics engine 56 through another function call to create a bitmap of the characters. As part of that notification, graphics driver 46 also notifies graphics engine 56 whether the graphics driver or the operating system is to transfer the bitmap to graphics device 48. How that decision is made will be described. If graphics driver 46 is to transfer the bitmap to graphics device 48, graphics engine 56 notifies the graphics driver of a location of the bitmap through a function call. Graphics driver 46 then transfers the bitmap from its location to the graphics device. If graphics engine 56 is to transfer the bitmap to the graphics device, it proceeds to do so.

This, of course, is only a description of the preferred embodiment. Graphics engine 56 or its equivalent may also be contained in the graphics interface or other parts of operating system 42.

Figure 3:
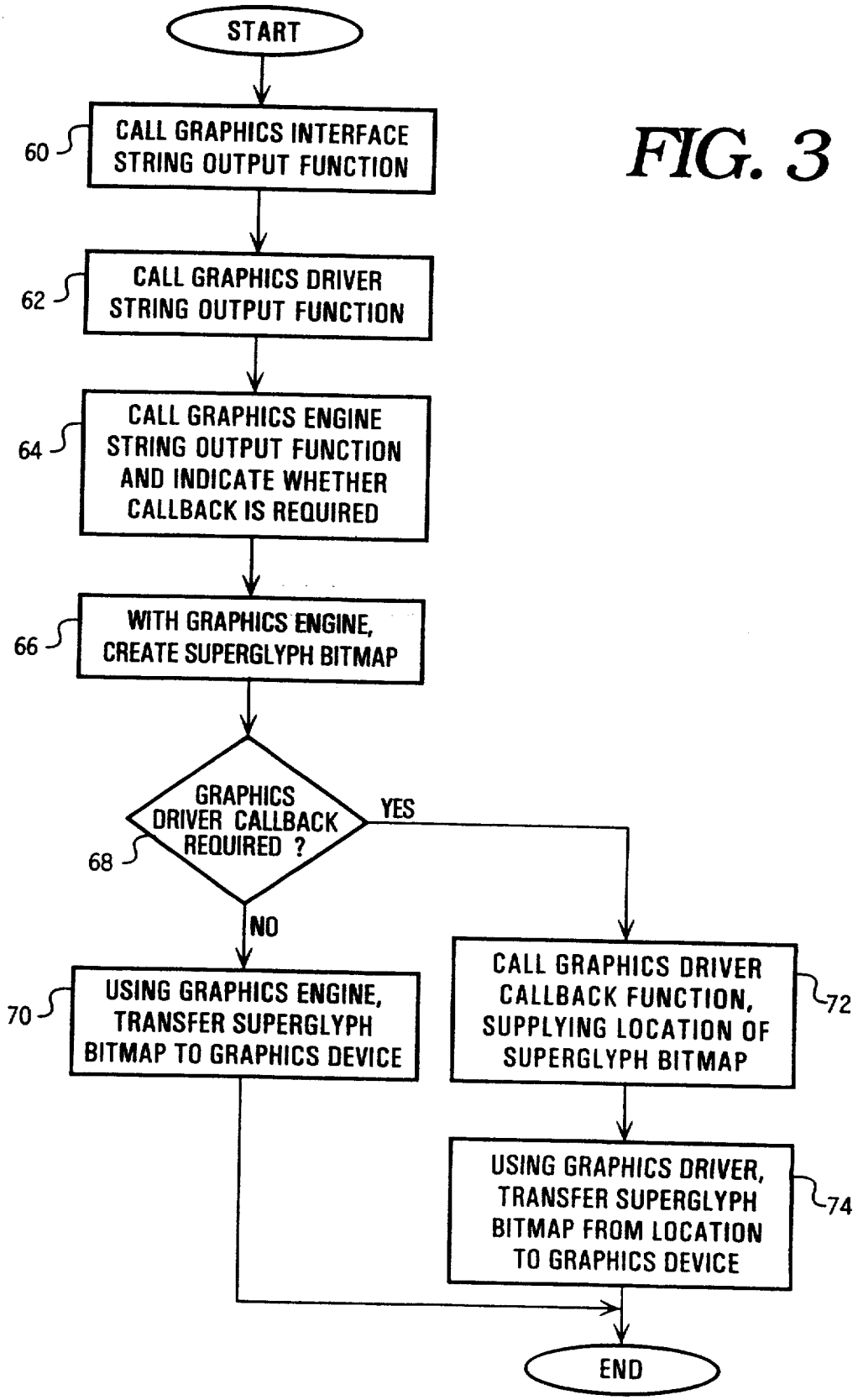
FIG. 3 is a flow chart of a method embodying the invention for creating and transferring a bitmap to a graphics device.
Figure 4:
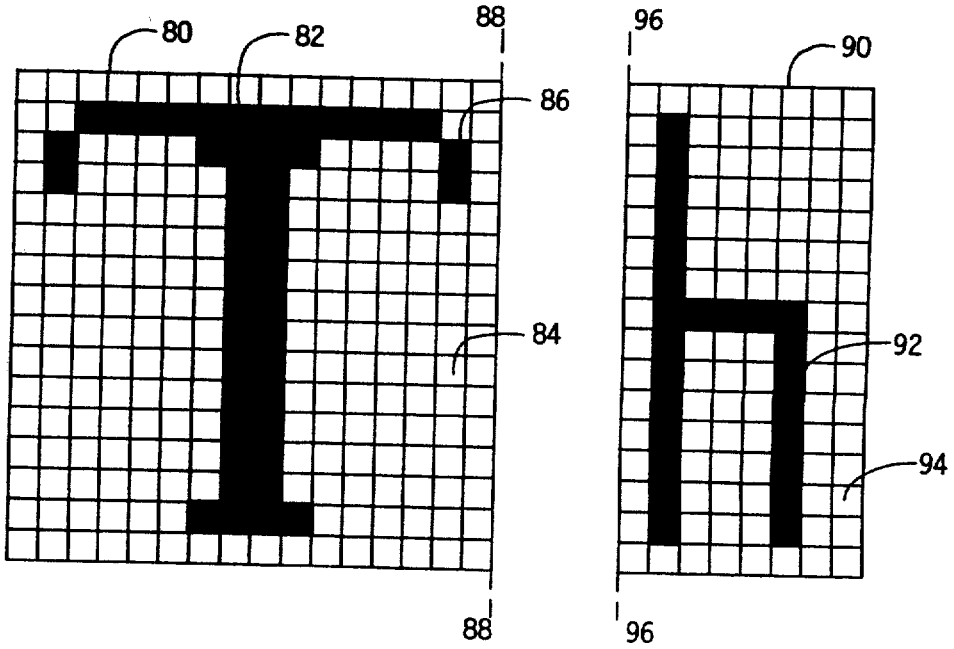
Figure 5:
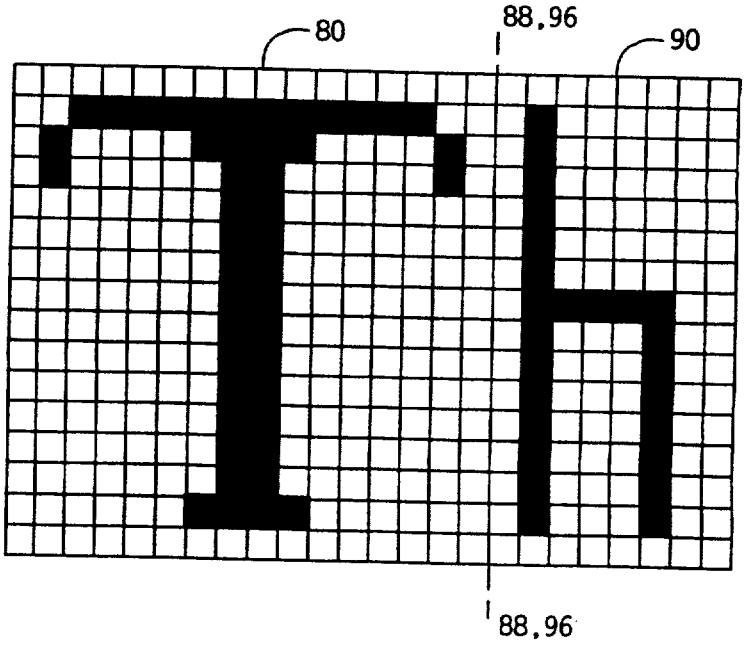
Figure 6:
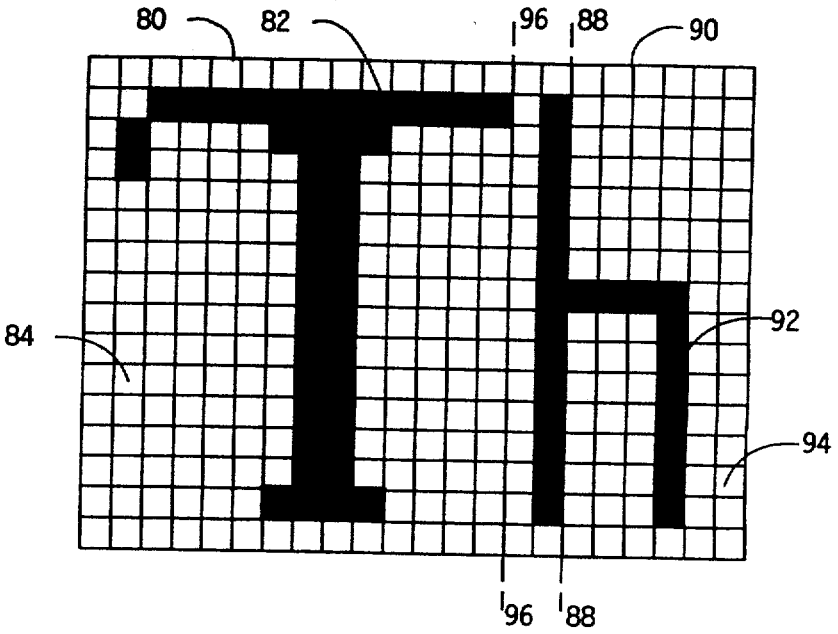
Figure 7:
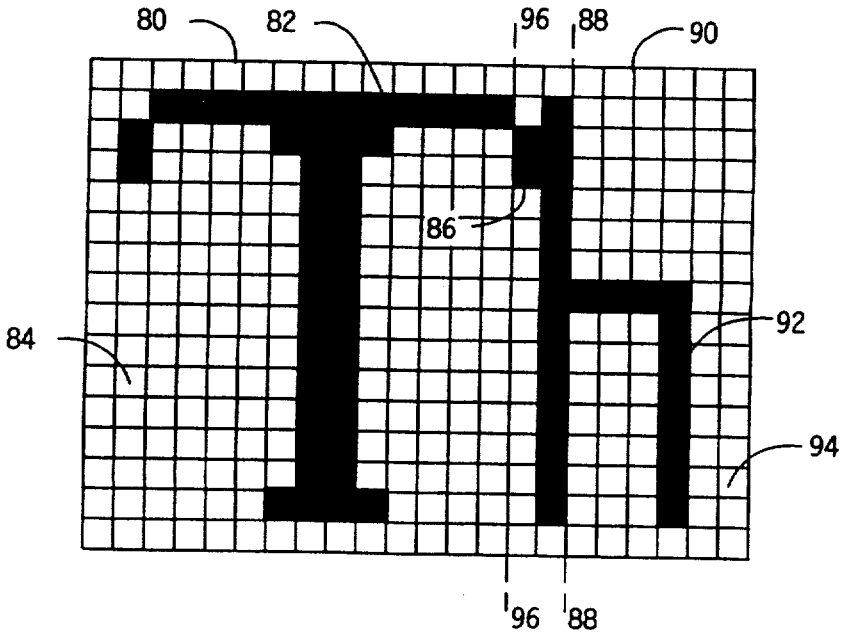
Figure 8:
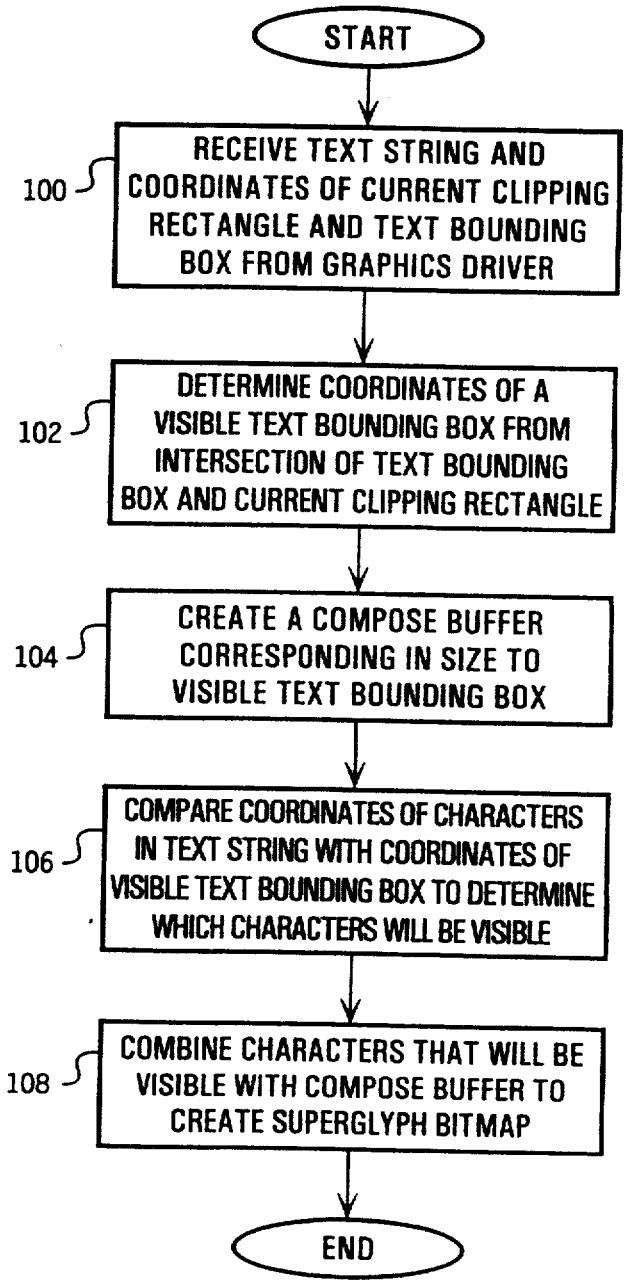

FIG. 3 is a flow chart showing in detail a method embodying the invention for creating and transferring a bitmap to a graphics device. The reference numerals in parentheses below refer to steps in the flow chart. When application program 44 desires to draw text on graphics device 48, the application program calls a string output function from graphics interface 54 (60), passing the function the necessary parameters such as string of character values, a count of characters in the string, a starting position, a physical font, and other information required to display the character string. Graphics interface 54 in turn calls a string output function from graphics driver 46 for graphics display device 29, again passing the necessary parameters (62).

However, unlike the prior approach, graphics driver 46 does not immediately attempt to draw the characters of the string. Instead, upon recognizing the function is one for displaying a text string output, graphics driver 46 calls a string output function in graphics engine 56 for creating a superglyph bitmap. As a parameter to this function, driver 46 passes a value indicating whether the graphics driver should be called back by graphics engine 56 to handle the transfer of the resultant superglyph bitmap to graphics device 48 (64). Preferably, the value is an address of a callback function contained within the graphics driver 46. A null (zero) address indicates that the graphics engine is to transfer the superglyph bitmap to the graphics device.

In response to the function call from graphics driver 46, graphics engine 56 then creates a "superglyph" bitmap (66). The graphics engine creates an opaque rectangle, or text bounding box, in a bitmap and then renders glyphs for all characters in the text string into the bitmap. The superglyph bitmap that results is a monochrome bitmap of appropriately-spaced and possibly overlapping characters, with each pixel in the bitmap represented in main memory 38 by one bit. For example, the characters themselves may be represented by 1's in memory and the opaque rectangle may be represented by 0's, or vice versa. A preferred method of creating the superglyph bitmap will be described with reference to FIG. 8.

A decision is then made whether graphics driver 46 or graphics engine 56 will transfer the superglyph bitmap to graphics device 48, based on the value of the address supplied by the graphics driver to the graphics engine (68). If the requested transfer is simply the copying of the monochrome bitmap from main memory 38 to screen memory within graphics device 48, then graphics engine 56 is capable of efficiently performing the transfer. The supplied address is zero and the graphics engine copies the superglyph bitmap from main memory 38 to screen memory (70). Ideally, graphics drivers 46 do not contain code for performing such simple, nonspecialized tasks that the operating system can adequately perform.

However, if the requested transfer is more complex, such as converting the monochrome bitmap to a color bitmap in the process of transferring the bitmap to video memory, then graphics driver 46 performs the transfer. For a specialized task such as this, the graphics driver contains code that operates special circuitry with the graphics device 48 for rapidly performing the monochrome-to-color conversion. The graphics engine 56, by contrast, could perform such a conversion only with software such as a look up table, which is inherently slower than the specialized hardware with the graphics device. In such circumstances the address value supplied by graphics driver 46 to graphics engine 56 is set to a nonzero value to indicate a callback is required. Graphics engine 56 responds by supplying graphics driver 46 with the location of the superglyph bitmap (72). The graphics driver then performs the transfer, taking advantage of the specialized hardware of the graphics device (74).

While the preferred embodiment of the method describes the creation of text bitmaps, the invention is not so limited. The method of the invention may also be used to create and transfer other types of bitmaps, so long as the bitmap format is understood by graphics driver 46 and transferrable to a particular graphics device 48. However, the invention is particularly well-suited to the transfer of text.

Figure 4:
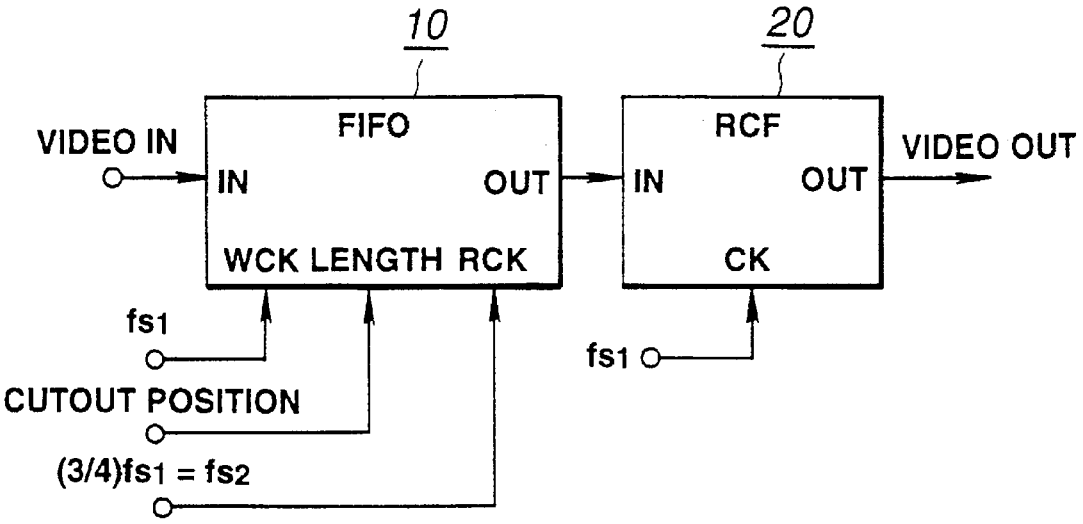
FIG. 4 is a portrayal of glyph bitmaps for two letters in a typical font.

The need for creating such a superglyph bitmap for proportionally-spaced, overlapping fonts is illustrated in FIGS. 4 through 7. FIG. 4 shows a glyph bitmap 80 for the capital letter "T". An area 82 representing the character itself is filled (such as with black color) and embedded within a rectangular background area or frame 84 of a contrasting color. Note that the right upper lobe 86 of the "T" is located only one pixel away from the right edge 88 of the bitmap. FIG. 4 also shows a glyph bitmap 90 for a lowercase letter "h", with the character itself represented by area 92 embedded within a rectangular background area 94. The left edge of glyph bitmap 90 is marked as 96.

Figure 5:
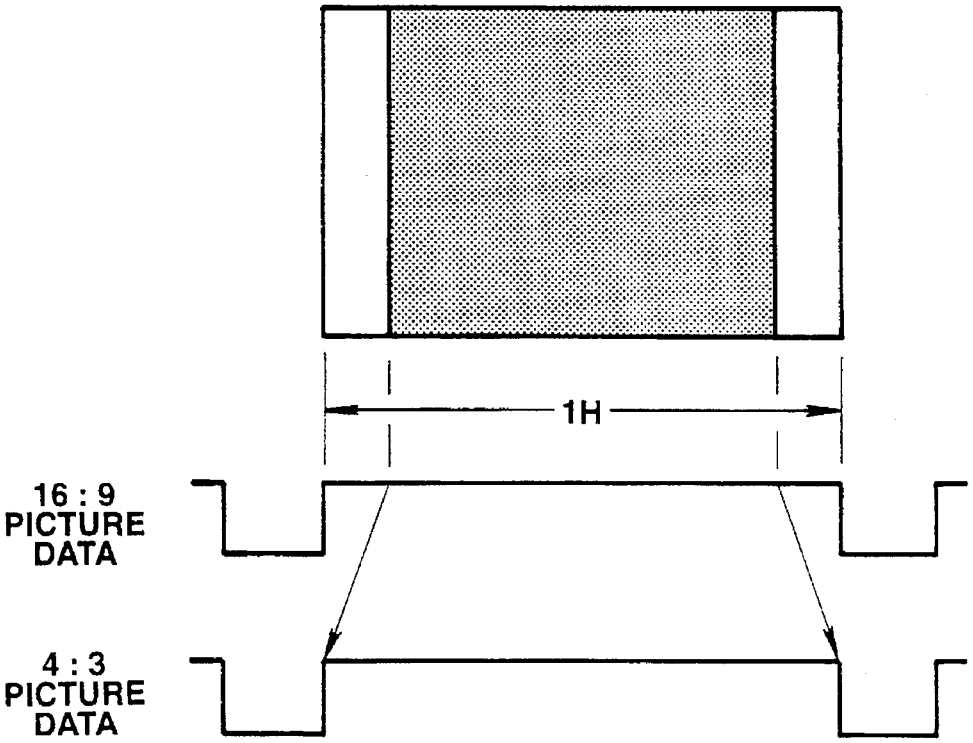
FIG. 5 is a portrayal of two glyph bitmaps placed adjacent to each other to form a string without kerning, i.e., overlapping.

Assume that FIG. 5 represents a font that is not proportionally spaced and in which each glyph bitmap is placed edge to edge with the adjacent bitmap so that no kerning occurs. In this circumstance, placing the "h" next to the "T" simply copies bitmap 90 to a location adjacent to bitmap 80 in screen memory and no overlap exists. There is no need for an opaque rectangle that must constantly be redrawn because the previously-drawn characters such as the "T" are not affected by the addition of a new character such as the "h". No flickering occurs. To conceal what otherwise would appear on the screen beneath the characters, the background areas of the bitmaps such as areas 84 and 94 are rendered opaque by filling them with an appropriate background color.

Figure 6:
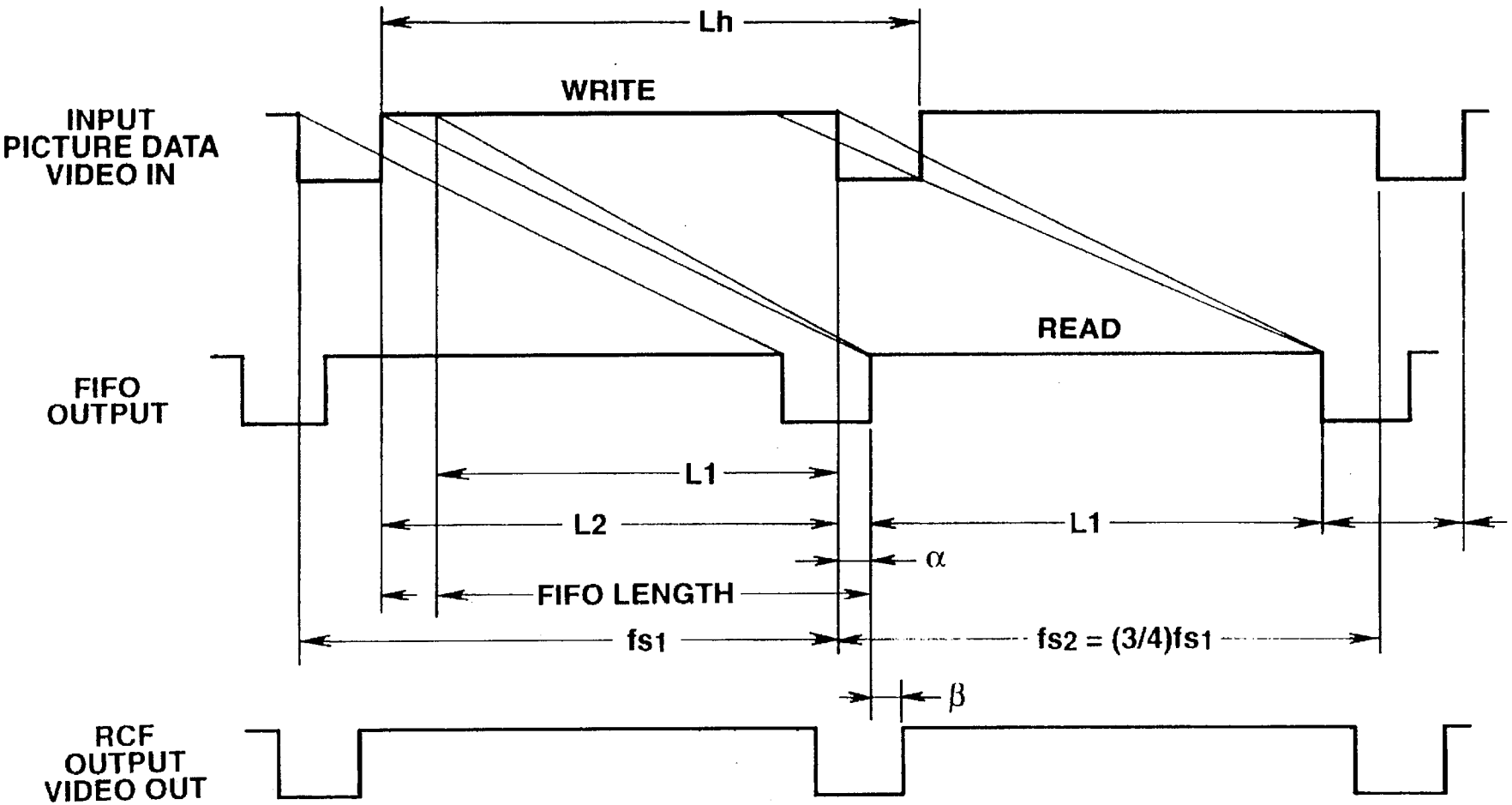
FIG. 6 is a portrayal of kerning, with two glyph bitmaps partially overlapping each other.

Assume that FIG. 6 represents a font that is proportionally spaced and in which the characters may be kerned, i.e., spaced to overlap. In this circumstance, placing the "h" adjacent to the "T" causes bitmap 90 to overlap and obliterate the right two pixel columns of bitmap 80. The "T" appears without its right upper lobe. The "T" may appear fully if the background 94 is rendered transparent, but then the background will not conceal what may lie underneath the characters in screen memory.

Figure 7:
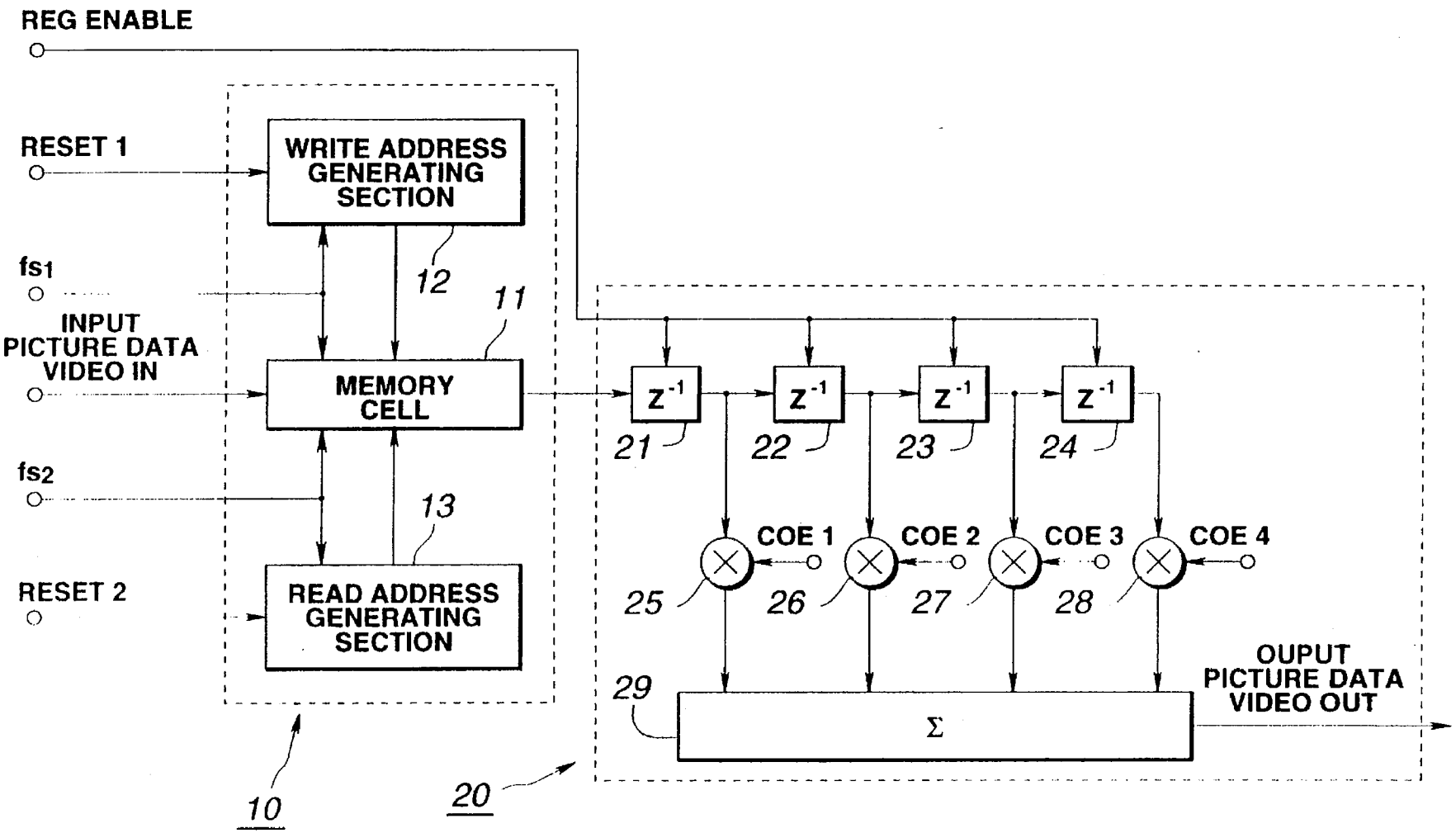
FIG. 7 is a portrayal of a superglyph bitmap created in accordance with to the invention, with two glyph bitmaps combined in such a way that their letters are completely visible.

The problems of kerning, flicker, complexity and redundant code may be solved by configuring graphics engine 56 for creating a superglyph bitmap that is available to all graphics drivers. In the present example, the superglyph bitmap combines an opaque rectangle with appropriately-spaced characters. FIG. 7 illustrates the result, with the entire "T" displayed adjacent to the "h" by overlapping glyph bitmaps 80 and 90, respectively.

Figure 8:
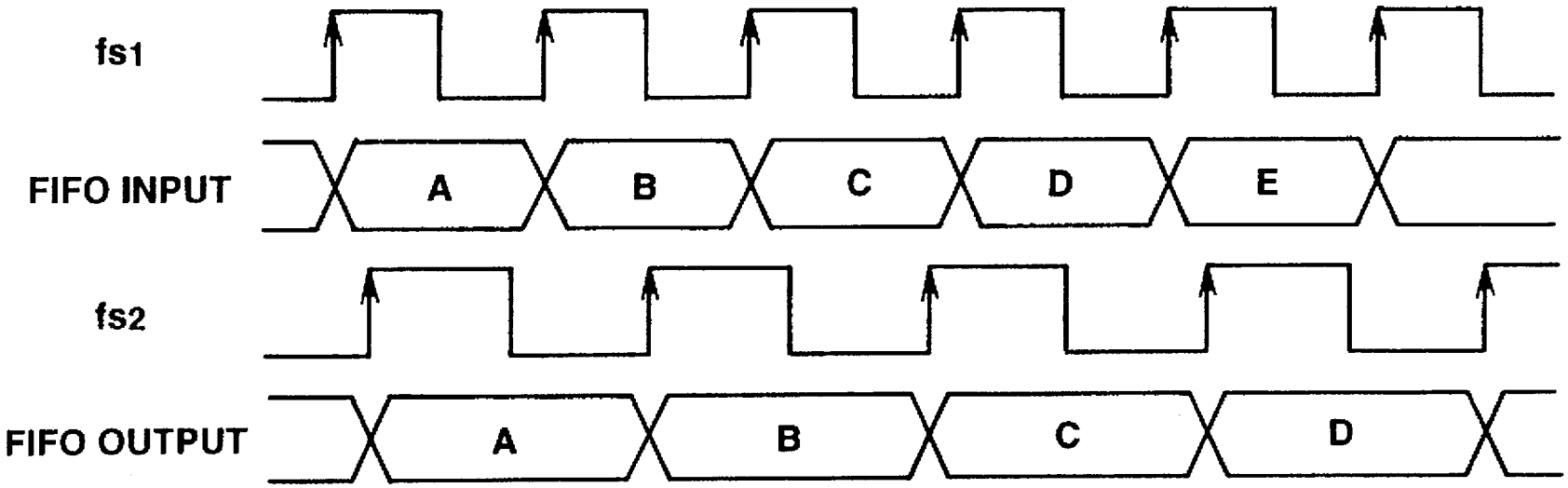
FIG. 8 is a flowchart of a preferred method embodying the invention for creating a bitmap.
Figure 10:
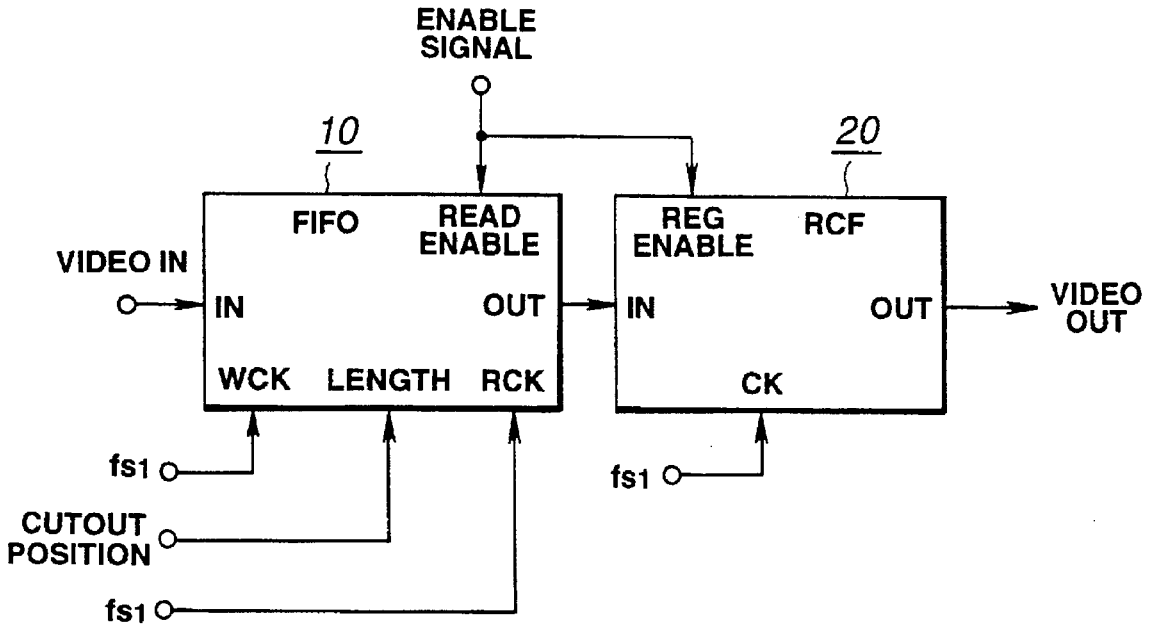
Figure 11:
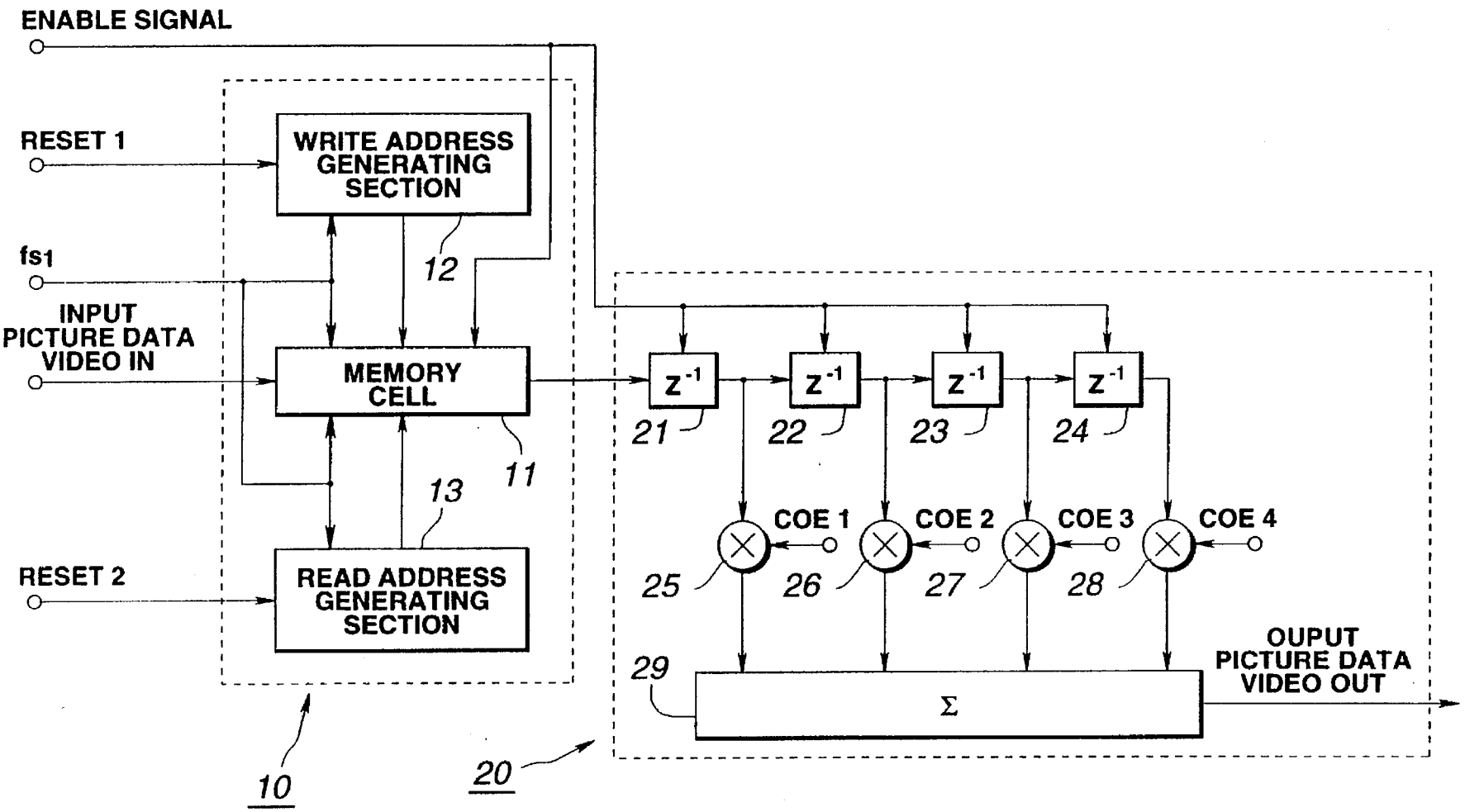
Figure 12:
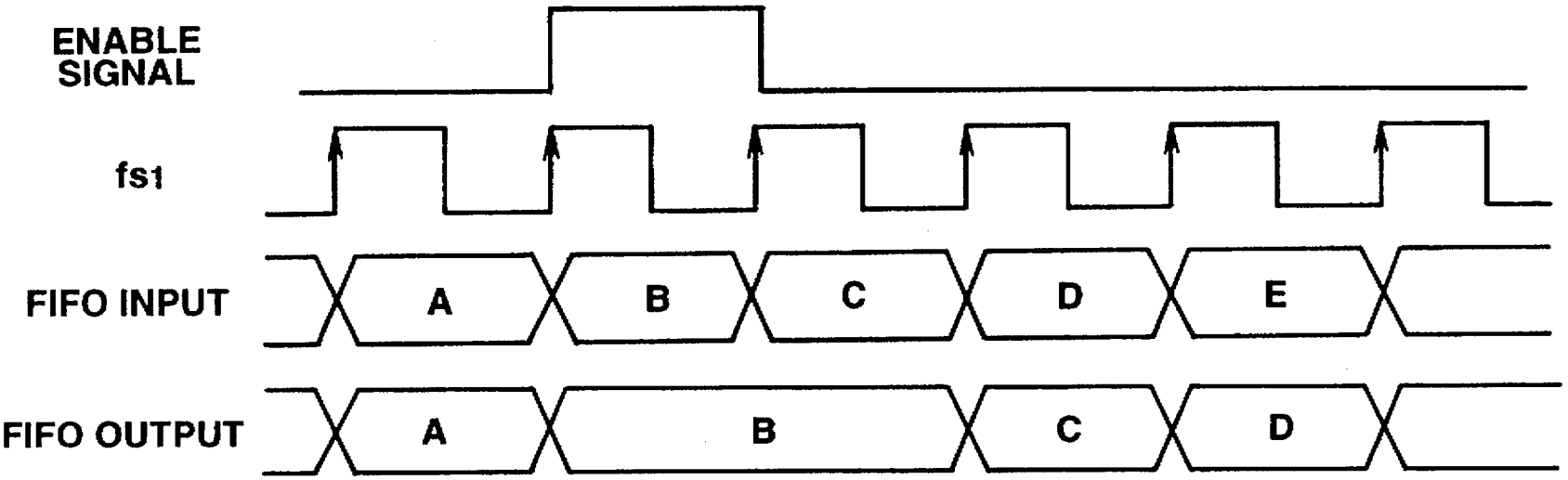
Figure 16:
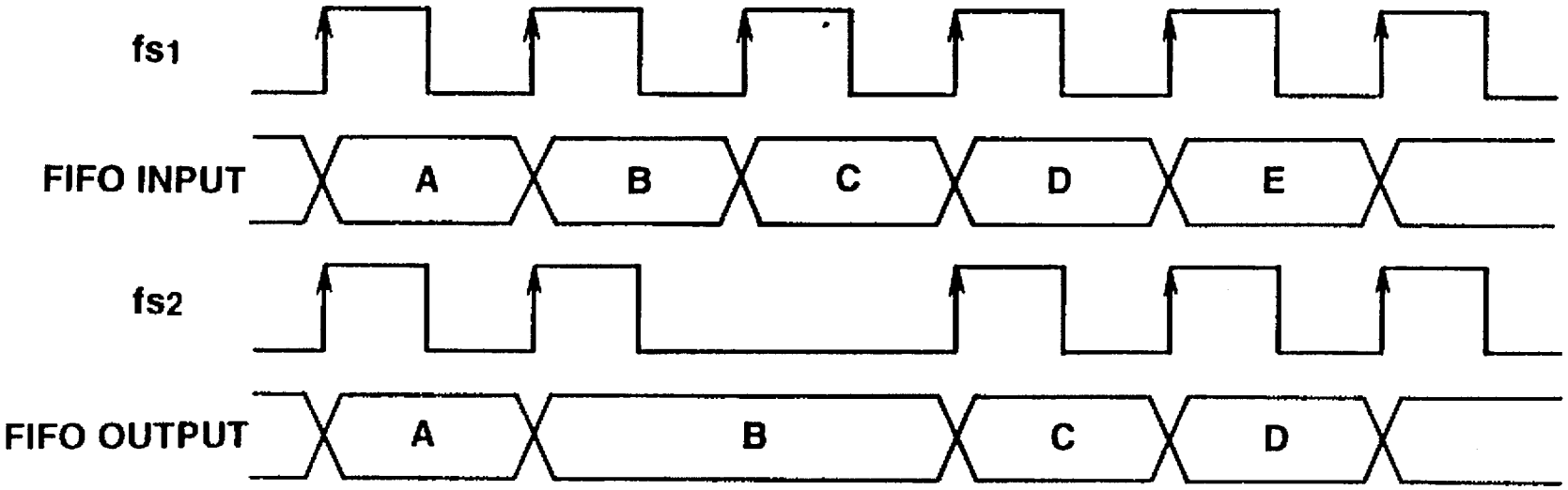
Figure 1:
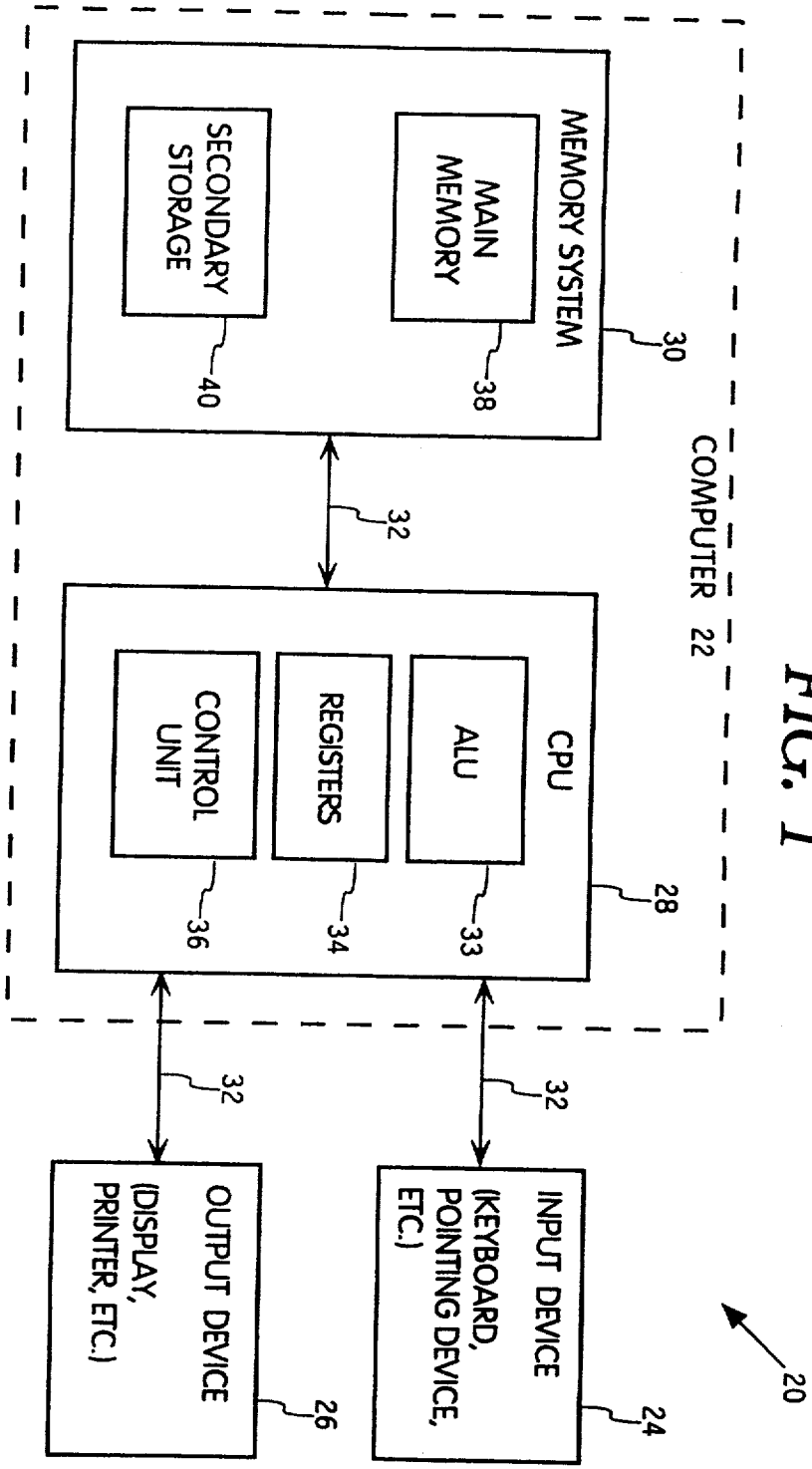

FIG. 8 is a flow chart showing the steps for creating a superglyph bitmap according to the invention (such as in step 66 of FIG. 3). In the present embodiment, graphics engine 56 creates this bitmap. However, it should be understood that other parts of operating system 42 could be configured to perform these steps as well.

In the process of creating a superglyph bitmap, graphics engine 56 receives from graphics driver 46 a pointer to the location of a text string in main memory 38 and the screen coordinates of a current clipping rectangle and text bounding box surrounding the text string (100). The current clipping rectangle is the area of the screen such as a viewing window in which the text is to appear. The coordinates of the text bounding box are normally computed by graphics interface 54 based on the size and spacing of the characters in the string.

The graphics engine then determines the screen coordinates of a visible text bounding box from the intersection of the text bounding box and clipping rectangle (102). For example, if the text bounding box encompasses an entire line of screen memory and the clipping rectangle (i.e., viewing window) occupies the upper left quadrant of the screen, then the visible text bounding box is the left half of the text bounding box.

In another step, the graphics engine creates a compose buffer in main memory 38 (104), the buffer comprised of a monochrome bitmap having one bit per pixel. The compose buffer corresponds in size to the visible text bounding box so that each pixel in the box is represented by a bit. The bits of the compose are initially of the same value, such as all 0's, to provide a drawing area of uniform color.

The graphics engine then compares the coordinates of each character in the text string (with the characters appropriately spaced and kerned) with the coordinates of the visible text bounding box to determine which characters are within the box and will be visible on screen (106). Characters may be all or partially visible in the box. The characters are clipped appropriately using well known techniques so that only those parts of characters within the visible text bounding box are displayed.

In a next step, graphics engine 56 combines the visible characters (as determined by the visible text bounding box) with the bits of the compose buffer to create the superglyph bitmap (108). A preferred form of combination is to logically OR the bits of the character glyph bitmaps with the bits of the compose buffer. The bits of the characters themselves are of opposite value from the bits of the compose buffer, and the bits of the background areas are the same value as the bits of the compose buffer. The result is characters that are clearly visible in the newly-created bitmap. Of course, other, equivalent combination techniques may also be used.

Having illustrated and described the principles of the invention in a preferred embodiment, it should be apparent to those skilled in the art that the embodiment can be modified in arrangement and detail without departing from such principles. In view of the many possible embodiments to which the principles of our invention may be applied, it should further be recognized that the illustrated embodiment is only a preferred example of the invention and should not be taken as a limitation on the scope of the invention. For example, the invention can be implemented in another embodiment to create other types of bitmaps in addition to superglyph bitmaps. And the various communications described between the graphics driver and operating system may be handled in different but equivalent ways. We therefore claim as our invention all that comes within the scope and spirit of the following claims.

We claim:

1. A method of creating a bitmap in memory and transferring the bitmap to a graphics device, comprising the following steps:

providing an operating system in memory for creating the bitmap and transferring the bitmap to the graphics device;

providing a graphics driver in memory for transferring the bitmap to the graphics device;

in response to a request to the graphics driver to transfer the bitmap to the graphics device, notifying the operating system to create the bitmap and further notifying the operating system whether the graphics driver or operating system is to transfer the bitmap to the graphics device;

creating the bitmap with the operating system;

in response to notification that the operating system is to transfer the bitmap to the graphics device, having the operating system transfer the bitmap to the graphics device; and in response to notification that the graphics driver is to transfer the bitmap to the graphics device, notifying the graphics driver of a location of the bitmap and having the graphics driver transfer the bitmap from the location to the graphics device.

2. The method of claim 1 wherein the graphics driver notifies the operating system to create the bitmap.

3. The method of claim 1 wherein the graphics driver notifies the operating system whether the graphics driver or operating system is to transfer the bitmap to the graphics device.

4. The method of claim 1 wherein a nature of the notification of whether the graphics driver or operating system is to transfer the bitmap to the graphics device is determined by whether the graphics driver or operating system is better suited to transfer the bitmap to the graphics device.

5. The method of claim 1 wherein the operating system notifies the graphics driver of the location of the bitmap.

6. The method of claim 1 wherein the operating system comprises:

a graphics interface for requesting that the graphics driver transfer the bitmap to the graphics device; and a graphics engine for creating and transferring the bitmap to the graphics device and for notifying the graphics driver of the location of the bitmap.

7. The method of claim 1 wherein the step of creating the bitmap comprises combining an opaque rectangle and glyphs for one or more characters into a single bitmap.

8. The method of claim 1 wherein the step of requesting the graphics driver to transfer the bitmap comprises requesting the graphics driver to draw text on the graphics device.

9. The method of claim 1 wherein the step of notifying the operating system whether the graphics driver or operating system is to transfer the bitmap to the graphics device comprises providing a parameter in a function call to the operating system.

10. The method of claim 1 wherein the step of notifying the graphics driver of the location of the bitmap comprises providing a parameter in a function call to the graphics driver.

11. An apparatus for creating a bitmap and transferring the bitmap to a graphics device, comprising:

an operating system contained within in memory for:

creating the bitmap;

transferring the bitmap to the graphics device in response to notification that the operating system is to transfer the bitmap to the graphics device; and notifying a graphics driver of a location of the bitmap in response to notification that the graphics driver is to transfer the bitmap to the graphics device; and the graphics driver contained within memory for:

notifying the operating system to create the bitmap;

notifying the operating system whether the graphics driver or operating system is to transfer the bitmap to the graphics device; and transferring the bitmap from the location to the graphics device in response to notification from the operating system of the location of the bitmap.

12. The apparatus of claim 11 wherein the operating system comprises:

a graphics interface for requesting that the graphics driver transfer the bitmap to the graphics device; and a graphics engine for creating and transferring the bitmap to the graphics device and for notifying the graphics driver of the location of the bitmap.

13. The apparatus of claim 11 wherein a nature of the notification of whether the graphics driver or operating system is to transfer the bitmap to the graphics device is determined by whether the graphics driver or operating system is better suited to transfer the bitmap to the graphics device.

14. The apparatus of claim 11 wherein the operating system is configured to create a single bitmap comprising an opaque rectangle combined with glyphs for one or more characters.

15. The apparatus of claim 11 wherein the graphics driver is configured to notify the operating system whether the graphics driver or operating system is to transfer the bitmap to the graphics device by providing a parameter in a function call to the operating system.

16. The apparatus claim 11 wherein the operating system is configured to notify the graphics driver of the location of the bitmap by providing a parameter in a function call to the graphics driver.

17. A method of creating a text bitmap in memory and transferring the bitmap to a graphics device, comprising the following steps:

providing an operating system in memory for creating the text bitmap and transferring the bitmap to the graphics device;

providing a graphics driver in memory for transferring the text bitmap to the graphics device;

in response to a request to the graphics driver to transfer a string of characters to the graphics device, notifying the operating system through the graphics driver to create the text bitmap representing the characters and further notifying the operating system whether the graphics driver or operating system is to transfer the text bitmap to the graphics device;

creating the text bitmap in memory by:

creating a compose buffer in memory corresponding in size to a visible area to be transferred to the graphics device;

determining which characters of the string are within the visible area; and combining the visible characters with the composed buffer to create the text bitmap;

in response to notification that the operating system is to transfer the text bitmap to the graphics device, having the operating system transfer the bitmap to the graphics device; and in response to notification that the graphics driver is to transfer the text bitmap to the graphics device, notifying the graphics driver through the operating system of a location of the text bitmap in memory and having the graphics driver transfer the text bitmap from the location to the graphics device.

18. The method of claim 17 wherein a nature of the notification of whether the graphics driver or operating system is to transfer the text bitmap to the graphics device is determined by whether the graphics driver or operating system is better suited to transfer the text bitmap to the graphics device.

19. The method of claim 17 wherein the operating system comprises:

a graphics interface for requesting that the graphics driver transfer the text bitmap to the graphics device; and a graphics engine for creating and transferring the text bitmap to the graphics device and for notifying the graphics driver of the location of the text bitmap.

20. The method of claim 17 wherein the step of notifying the operating system whether the graphics driver or operating system is to transfer the text bitmap to the graphics device comprises providing a parameter in a function call to the operating system.

* * * * *

UNITED STATES PATENT AND TRADEMARK OFFICE

CERTIFICATE OF CORRECTION

PATENT NO. : 5,659,336

DATED : August 19, 1997

INVENTOR(S) : Patrick et al.

It is certified that error appears in the above-identified patent and that said Letters Patent is hereby corrected as shown below:

IN THE DRAWINGS:

Please delete the Drawings Sheets 1 - 14, consisting of Figs. 1 - 16, and substitute the sheets 1 - 6, consisting of Figs. 1 - 8 as shown on the attached sheets.

Signed and Sealed this

Sixth Day of January, 1998

*Attest:*

Bruce Lehman

BRUCE LEHMAN

*Attesting Officer*

*Commissioner of Patents and Trademarks*